US005570408A

United States Patent [19]

Gibson

[11] Patent Number: 5,570,408

[45] Date of Patent: Oct. 29, 1996

[54] HIGH INTENSITY, SMALL DIAMETER X-RAY BEAM, CAPILLARY OPTIC SYSTEM

[75] Inventor: David M. Gibson, Voorheesville, N.Y.

[73] Assignee: X-Ray Optical Systems, Inc., Albany, N.Y.

[21] Appl. No.: 395,714

[22] Filed: Feb. 28, 1995

[51] Int. Cl.[6] ..... G21K 1/02

[52] U.S. Cl. ..... 378/145; 378/84

[58] Field of Search ..... 378/84, 85, 34, 378/145, 147, 148, 149, 161

[56] References Cited

U.S. PATENT DOCUMENTS 5,276,724 1/1994 Kumasaka et al. ..... 378/34

*Primary Examiner*—David P. Porta

*Assistant Examiner*—Don Wong

*Attorney, Agent, or Firm*—Heslin & Rothenberg, P.C.

[57] ABSTRACT

A system comprising a novel combination of a multiple-channel monolithic capillary optic and an x-ray source with a spot size of less than 300 microns to produce a high intensity small diameter x-ray beam is described. A system of this invention can be easily adapted for use in the analysis of small samples where an intense quasi-parallel, or converging x-ray beam is required.

11 Claims, 5 Drawing Sheets

HIGH INTENSITY, SMALL DIAMETER X-RAY BEAM, CAPILLARY OPTIC SYSTEM

STATEMENT AS TO RIGHTS UNDER FEDERALLY SPONSORED RESEARCH

This invention was made with government support under Contract No. 70NANB2H1250 the U.S. Government has certain rights in the invention.

FIELD OF THE INVENTION

This invention relates broadly to the field of x-rays. More particularly this invention relates to the field of x-ray optics. This invention provides a device and a method for improvement in the capability of capillary x-ray optic/x-ray source systems to produce high intensity, small diameter x-ray beams.

BACKGROUND OF THE ART

When samples are analyzed by various x-ray techniques, such as x-ray diffraction, it is desirable that the dimensions of the x-ray beam hitting the sample be on the order of the sample size, or of the order of the spot on the sample to be examined. This criteria on beam size is important because it maximizes spacial resolution, while minimizing background noise produced by unwanted photons. In many cases, for example in the case of x-ray diffraction of protein crystals, sample sizes are very small, and conventional x-ray diffraction equipment does not function efficiently. When traditional laboratory x-ray sources are used to analyze such small samples, beams of appropriate size are typically obtained by collimation methods. This includes such things as passing the x-ray beam through pin holes cut into x-ray absorbing materials such as lead. Because low beam divergence is also desirable, these pin holes must be placed a significant distance away from the source. This means that the solid angle of collection from the source is quite small. This in turn results in a very low intensity beam reaching the sample. One significant disadvantage of a low intensity beam is that measurement times can be extremely long. For some samples this is merely an inconvenience. However, for samples like protein crystals which have relatively short life times, this extended period of analysis can render the analysis technique useless. In all cases, extended measurement times lead to a decrease in the signal-to-noise ratio. Also, it is important for commercial analysis operations to maximize the sample through-put by minimizing analysis time. Shorter analysis times can thus lead to substantial financial rewards.

It is known in the art that to obtain more x-rays from a source, a larger spot size on the anode is required. Thus, conventional wisdom dictates that in order to decrease power transmitted to a sample, either with or without an optic, a more powerful source with a larger spot size should be used. A general rule that is followed is that the source spot size should be the size of the sample being analyzed.

It is known to the art that single hollow glass capillaries can form x-ray beams of very small dimensions see for example P. B. Hirsch and J. N. Keller, Proc. Phys. Soc. 64 369 (1951). Tapering these single capillaries to further limit output spot size is also known to the art see E. A. Stern et. al.Appl. Opt. 27 5135 (1988). However, both these devices only capture x rays from a very small portion of the source. Thus, their use also leads to x-ray beams of less intensity than is desired. Yet another disadvantage of the tapered devices is that the minimum x-ray spot size is located right at the tip of the device. This places strict limitations on the positioning of a sample. In addition, these single tapered capillaries can only form a small spot with considerable divergence. Often times for diffraction experiments, a parallel beam is desirable.

Also known to the art are multi-fiber polycapillary x-ray optics. These devices form a particular class of a more general type of x-ray and neutron optics known as Kumakhov optics. See for example U.S. Pat. No. 5,192,869 to Kumakhov. Disclosed in this patent are optics with multiple fibers which are designed to produce high flux quasi-parallel beams.

Although these optics can capture a large solid angle of x-rays from diverging sources, their potential for capturing from a small spot source or for forming small dimension output beams is limited by the relatively large outer diameter of the individual polycapillary fibers. The outer diameter of the fibers is on the order of 0.5 millimeters. Because of the fiber outer diameter these multi-fiber optics have a minimum input focal length roughly 150 millimeters. The critical angle for total external reflection at 8 keV for glass is four milliradians. Effective transmission after many reflections is obtained only if the photons are approximately one-half the critical angle. So using 0.5 mm diameter fibers, geometry shows that with a source as small as 100 μm, the source-optic distance should be at least 150 mm for the outer channels to transmit effectively. Because of this relatively long input focal distance to capture a large angular range of x-rays from the source the input diameter needs to be relatively large which in turn constrains the minimum diameter and maximum intensity (photons/unit area) of the output beam. The minimum beam diameter for a multi-fiber polycapillary optic with a 0.15 radian capture angle which forms a quasi-parallel beam is on the order of 30 millimeters. These optics are thus not appropriate to produce the intense small diameter x-ray beams needed for small sample diffraction experiments such as protein crystallography. For focusing optics, because of the fiber diameter, the minimum focused spot sized has a diameter on the order of 0.5 millimeters.

OBJECT OF THE INVENTION

Thus it is the object of the subject invention to provide a solution to the long felt need in the art for laboratory based, small dimension, high intensity x-ray beams. It is another object of this invention to allow the analysis sample to be placed at a position removed from the output end of the device. It is yet another object of this invention to provide a small, intense x-ray beam which is highly collimated with a minimum of divergence. Yet another object of this invention is to produce small, high intensity, focused x-ray spots. Another object of this invention is to provide these benefits in a relatively compact, and cost effective system.

BRIEF SUMMARY OF THE INVENTION

The subject invention accomplishes these objects with a carefully engineered x-ray source/capillary optic system comprising:

1) A monolithic multiple-channel capillary optic with scaled down input and output diameters minimized with respect to photon energy, source diameter, and channel diameter; and,
2) an x-ray source with a spot size designed to maximize optic output intensity for a desired output beam diameter.

The specially designed optic is positioned within 60 mm or less relative to the x-ray source.

Monolithic optics are an essentially integral one-piece structure in which fiber channels are closely packed and self-aligning along their entire length. At the input end of the optic the channels are oriented to aim substantially at the x-ray source. The output end of the optic can be shaped to form either a converging, or a quasi-parallel beam, depending on the intended use of the invention.

The smaller source, although less powerful, provides an increase in the areal density of x-rays. The monolithic optic enables the efficient capture of the small spot x rays, because each individual channel can be aligned more efficiently with the source spot. Surprisingly, it has been discovered that a small spot, lower power source, when combined with a monolithic capillary optic's superior x-ray collection abilities, can lead to a higher intensity of x-rays at the output of the optic when compared with the use of a large spot, higher power source with or without an optic.

The basic idea behind the invention then, is to continue to capture the x-rays from the source, and to squeeze these photons into a smaller output space in order to produce the desired high intensity, small diameter beam. This requires significant reengineering of existing optic designs, and modification of the x-ray source used. The first modification is that the input diameter of the optic must be decreased from what is currently known. A critical point to the invention is that in order to keep the same amount of photons entering the input end of the optic, the optic must be moved closer to the x-ray source to maintain the same capture solid angle. Characteristic input focal lengths of the subject invention are less than half of the roughly 150 millimeters required for the best multi-fiber polycapillary optics. Moving closer and using smaller input diameters all aimed at a common point, means the optic will "see" a smaller portion of the source. Thus, another key element of the subject invention is to decrease the source spot size in order to increase the power density and therefor the x-ray production from the area of the source from the which the optic captures photons. This is done in spite of the fact that the total number of x-rays emerging from the source is decreased. This invention provides for more efficient use of existing x-ray power.

BRIEF DESCRIPTION OF DRAWINGS

These and other objects, advantages and features of the present invention will be more readily understood from the following detailed description of certain preferred embodiments of the invention, when considered in conjunction with the accompanying drawings in which.

BEST MODE FOR CARRYING OUT THE INVENTION

Figure 1:
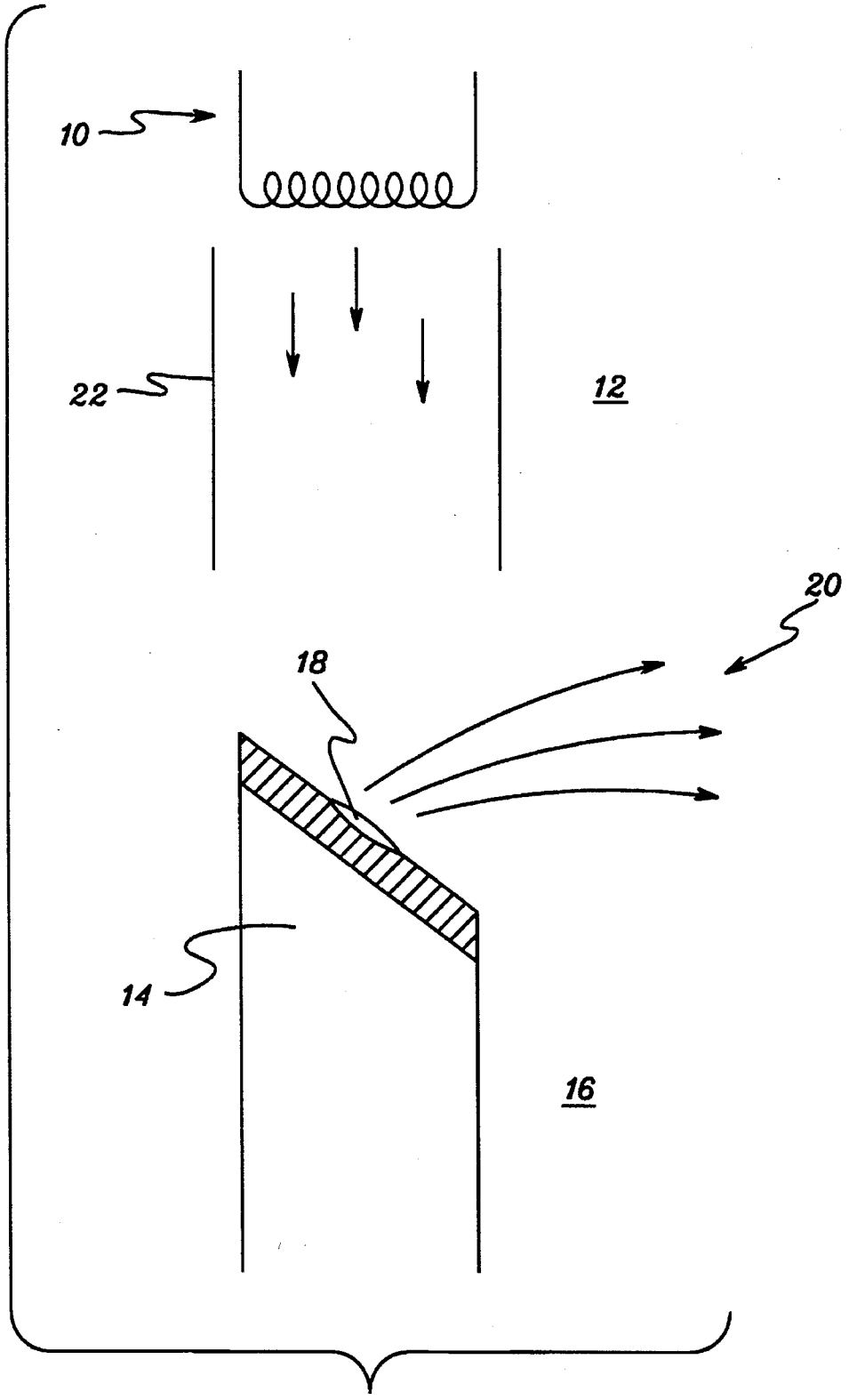
fig. 1 PRIOR ART
FIG. 1 is a schematic diagram of an x-ray source.

Referring now to FIG. 1, the basic elements of a typical x-ray source are shown. Filament 10, is heated, by applying a voltage, to a temperature such that electrons 12, are thermally emitted. These emitted electrons are accelerated by an electric potential difference to anode 14, which is covered with target material 16, where they strike within a given surface area of the anode which is called the spot size 18. X-rays 20, are emitted from the anode as a result of the collision between the accelerated electrons and the atoms of the target. In order to control the spot size, electromagnetic focusing means 22, is positioned between electron emitting filament 10, and anode 14, so that the electron beam passes within its area of influence. X ray sources with spot sizes of 2 microns or less are available commercially. However, as the electron spot size decreases, so does the production of x rays.

Figure 2:
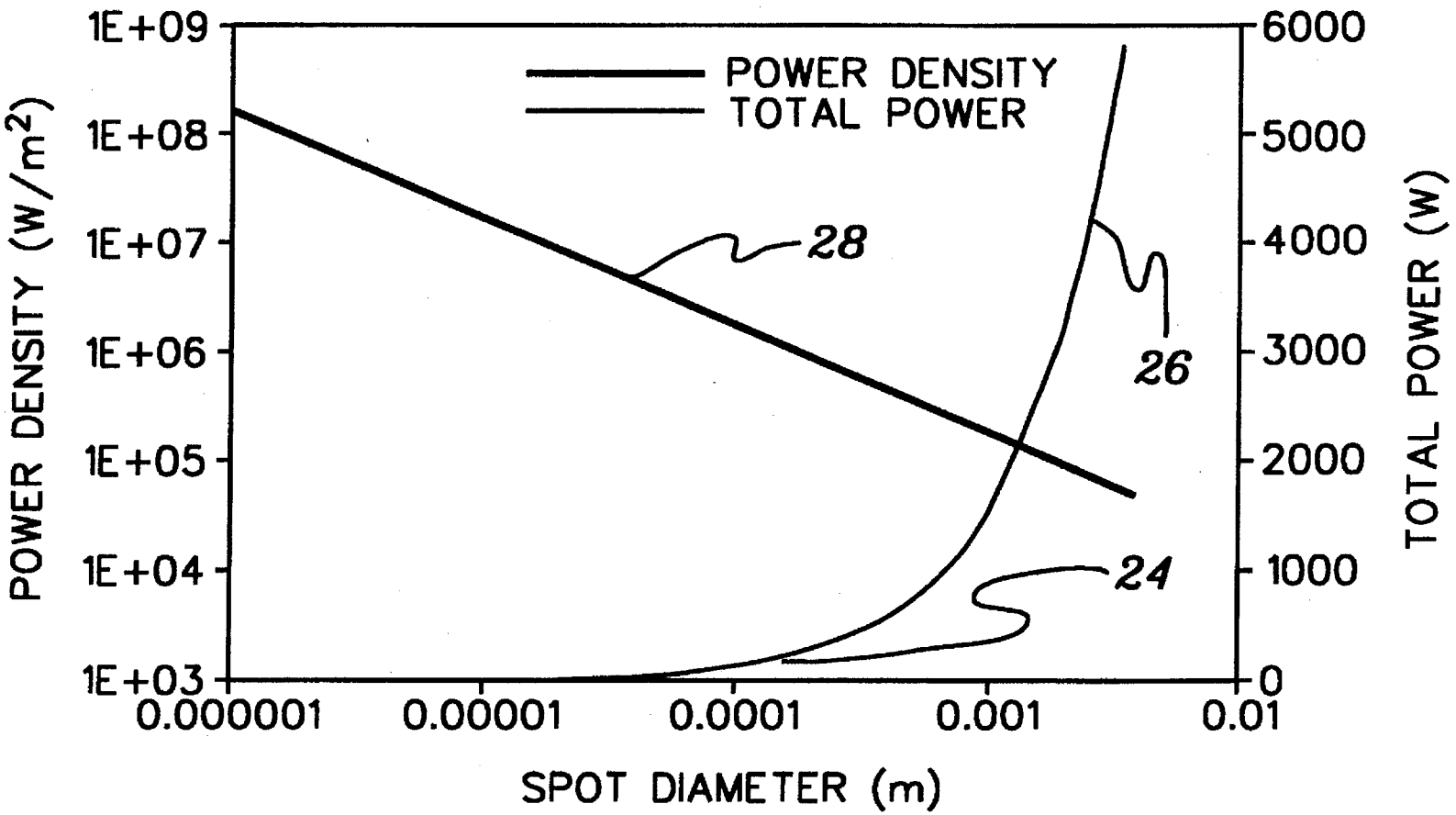
FIG. 2 is a graph of power density and total power as a function of spot size diameter.

FIG. 2 shows how x ray power (production of x rays), and the power density (power/spot area) of a source varies with spot diameter. Noting that the linear vertical scale on the right of the graph is used for the total power, it can be seen from the lower tail 24, of total power curve 26, that power decreases nearly linearly with spot diameter for very small spot sizes. Turning our attention now to the power density curve 28, and noting that the vertical scale on the left of the graph, which applies to this curve is logarithmic, it can be seen that there is an inverse relationship between the power density and the spot diameter. The reason for this is that the total power varies linearly with spot diameter, while the area varies as the inverse of the square of the spot diameter. Thus it can be seen that even though total x-ray production is decreased, the power density increases with decreasing spot size.

Monolithic capillary optics allow unprecedented possibilities for efficient use of the increased power density of small spot x-ray sources. The combination of the smaller spot source, and properly engineered monolithic capillary optic of the subject invention can thus lead to a substantial increase in intensity of small diameter output x-ray beams.

Figure 3:
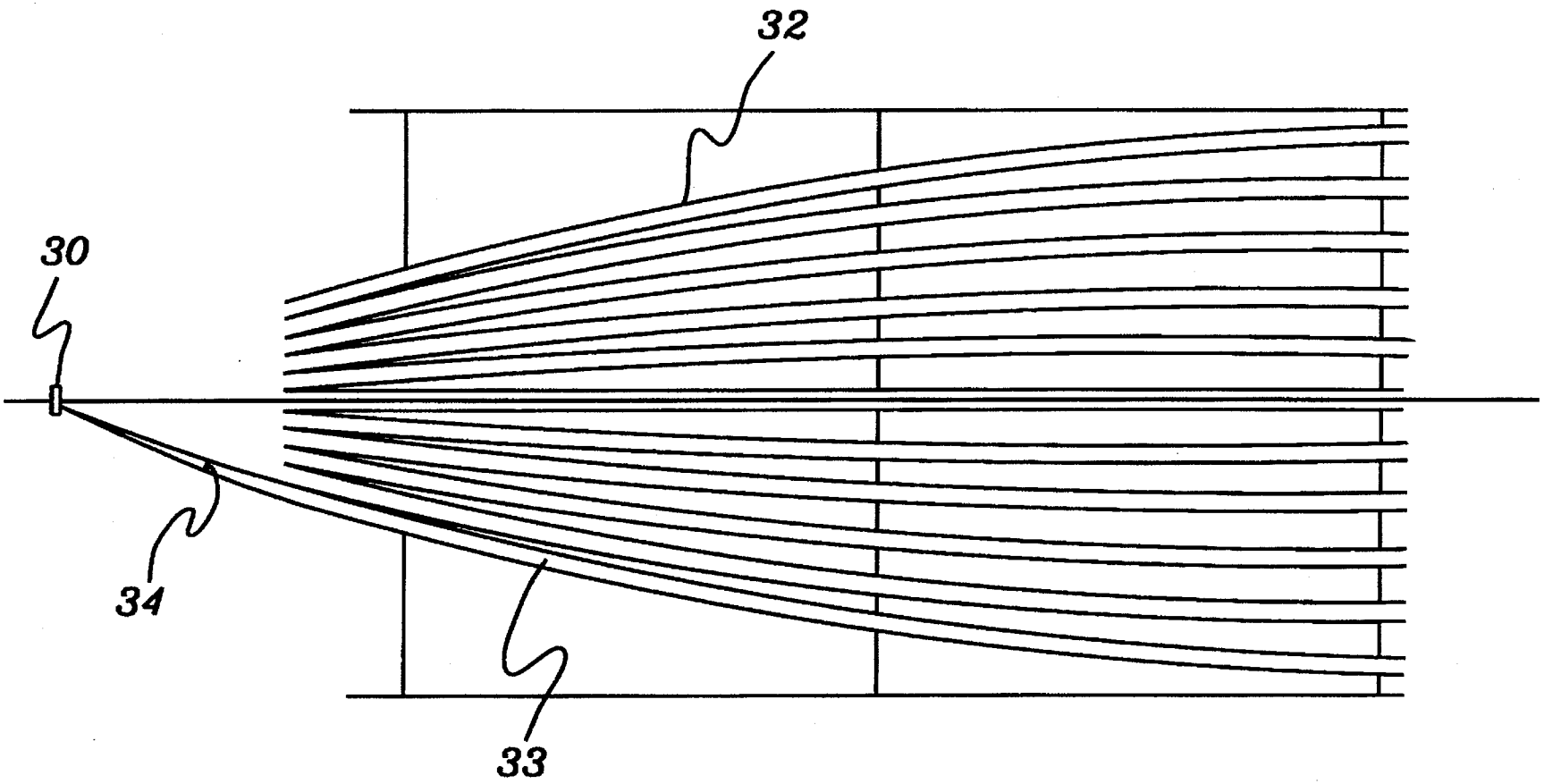
fig. 3 PRIOR ART
FIG. 3 depicts a multi-fiber polycapillary optic.

Specific design parameters vary depending on the energy of x-rays used. Two types of systems are particularly pointed out. First, a system in which a very intense small diameter quasi-parallel beam is formed and second a system in which a very small, intense converging x-ray spot is formed. In all cases, systems of the type defined by the subject invention can be easily differentiated from other prior art systems based on a much reduced source to optic distance. FIG. 3 shows an x-ray source 30, and multi-fiber polycapillary optic 32. In order for the polycapillary fiber 33 to efficiently capture radiation from source 30, the collection angle 34 of the capillary must be less than the critical angle for total external reflection. This angle is dependent on the x-ray energy. For a typical example of an approximately 8 keV optic with polycapillary outer diameters of around 0.5 millimeters, simple geometric considerations lead to the conclusion that the optic must be placed at least 150 millimeters away from the source. The subject invention is defined by optics which are placed no more than half that distance from the source.

Figure 4:
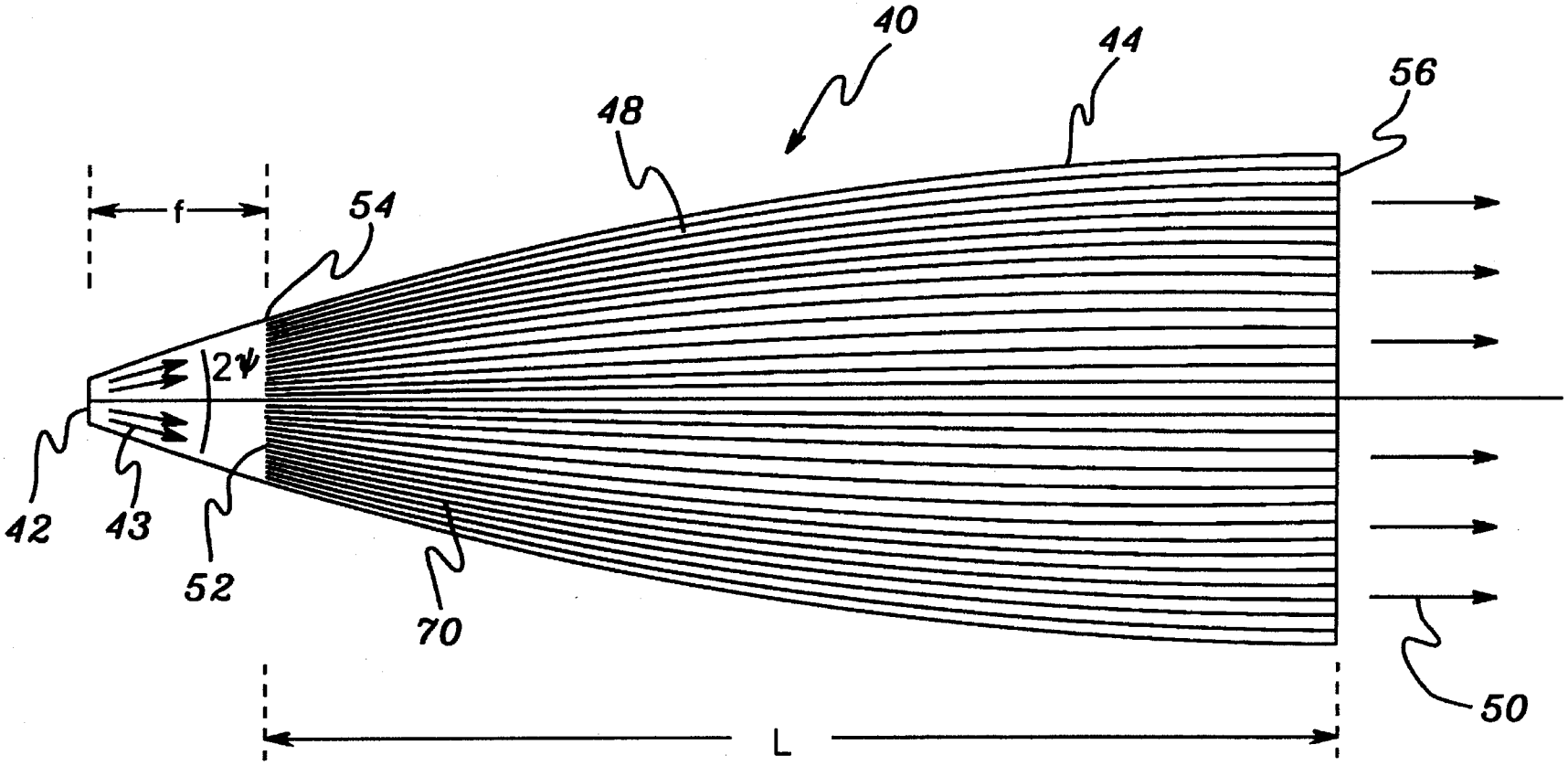
FIG. 4 depicts a monolithic capillary optic and source in accordance with the present invention.

The first embodiment of the subject invention is shown in FIG. 4. The system 40, for producing a high intensity, small diameter x-ray beam comprises two main components; a small spot x-ray source 42, and a monolithic capillary optic 44. The two components are separated by a distance f, known as the focal distance, measured along optical axis 46. The optic 44 comprises a plurality of hollow glass capillaries 48 which are fused together and plastically shaped into configurations which allow efficient capture of divergent x radiation 43 emerging from x-ray source 42. In this example the captured x-ray beam is shaped by the optic into a quasi-parallel beam 50. The output beam is not completely parallel because of divergence due to the finite critical angle of total external reflection. The channel openings 52 located at the optic input end 54 are roughly pointing at the x-ray source. The ability of each individual channel to essentially point at the source is of critical importance to the subject invention for several reasons: 1) It allows the input diameter of the optic to be sufficiently decreased, which in turn leads to the possibility of smaller optic output diameters; 2) it enables efficient capture of x-rays even when the source spot is decreased; 3) it makes efficient x-ray capture possible for short optic to source focal lengths. The diameters of the individual channel openings 52 at the input end of the optic 54, are smaller than the channel diameters at the output end of the optic 56. The class of optics used in the subject invention are monolithic. This means that the walls of the channels themselves 70, form the support structure which holds the optic together. For this case, the maximum capture angle is given by $2\psi$, where $\psi$ is the maximum bend angle of a curved capillary.

In a preferred embodiment the x-ray source 42 has a spot size of roughly 30 microns and is located approximately 1.0 millimeter from the input end 54 of capillary optic 44. The collection angle $\psi$ for this optic is around 0.2 radians. The optic produces an output beam 50 with a diameter of essentially 1.0 millimeter. The overall length of the optic is approximately 8.0 Millimeters. The increase in intensity is expected to be more than roughly 2 orders of magnitude brighter than currently available laboratory sources.

Figure 5:
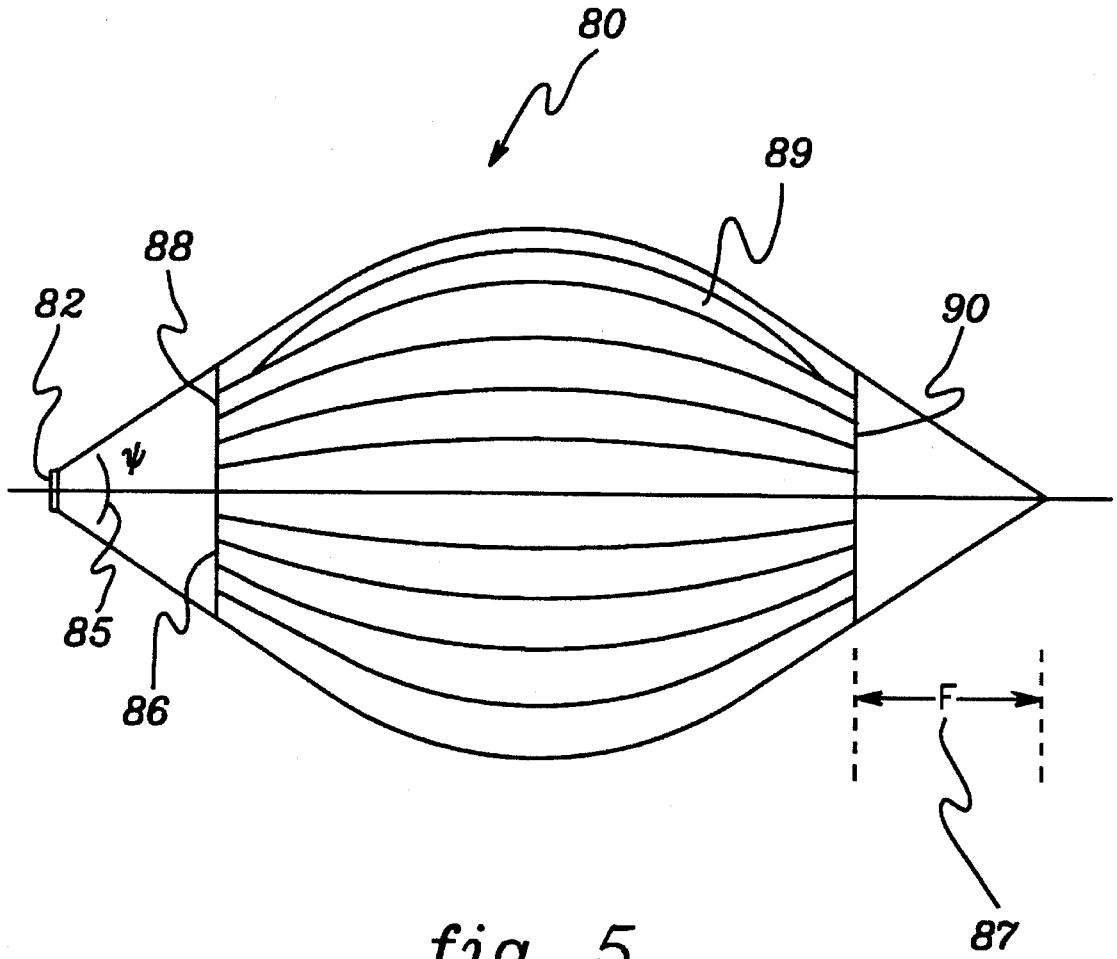
FIG. 5 depicts another embodiment of monolithic capillary optic in accordance with the present invention.

FIG. 5 shows a second embodiment of the subject invention. Again the source/optic system 80, comprises small spot x-ray source 82, and monolithic capillary optic 84. The optic has channels formed by individual glass capillaries 89 which have been fused together. The channel openings 86 at the input end 88 are positioned to capture radiation from divergent source 82. In this particular embodiment, however, the optic output end 90 is shaped to form a very small spot converging beam. For this case, because the radiation is turned through twice the angle of the quasi-parallel output optic, so the maximum capture angle is just $\psi$, the maximum bend angle. A preferred embodiment of this system, designed for approximately 8 keV x-rays, can be specified as follows. Again referring to FIG. 5, the x-ray source 82, has an anode spot size of around 100 micrometers. The converging optic 84, is placed essentially 27 millimeters in front of the source. The acceptance angle of the optic 85 is roughly 0.13 radians, and the optic has an output focal length 87 of nearly 2 millimeters. The overall length of the optic is about 165 millimeters. The optic input diameter 88 is approximately 7 millimeters, with input channel diameters of essentially 14 micrometers. The output diameter 90 is roughly 0.6 millimeters. The maximum channel diameter is around 10 micrometers.

This invention has been specified in part by specific embodiments. It is to be understood that it will be apparent to those skilled in the art that various modifications, substitutions, additions and the like can be made without departing from the spirit of the invention, the scope of which is defined by the claims which follow and their equivalents.

I claim:

1. Apparatus for producing an x-ray beam with a width 'w', said apparatus comprising:

an x-ray source having a spot size width 'y'; and a multiple-total-external reflection monolithic capillary optic ("optic") having an input and an output and being positioned such that said input to said optic faces said x-ray source and is disposed at an optic-to-source distance of less than 60 millimeters, said optic having multiple channels each of which has an input aimed at said x-ray source, said output of said optic providing said x-ray beam of width 'w'.

2. The apparatus of claim 1, wherein said spot size width 'y' is of less than 300 micrometers.

3. The apparatus of claim 2, wherein said x-ray beam comprises a quasi-parallel x-ray beam.

4. The apparatus of claim 1, wherein said x-ray beam comprises a quasi-parallel x-ray beam.

5. The apparatus of claim 1, wherein said spot size width 'y' is sufficiently small to maximize intensity of said x-ray beam with width 'w' with said optic disposed at said optic-to-source distance of <60 millimeters.

6. The apparatus of claim 1, wherein said x-ray beam comprises a quasi-parallel x-ray beam and said x-ray source has a spot size width 'y' of approximately 30 micrometers, and wherein the optic-to-source distance is approximately 1 millimeters such that said optic produces at its output a quasi-parallel x-ray beam with a width 'w' of 1 millimeter.

7. Apparatus for producing a focused x-ray beam with a spot width 'w', said apparatus comprising:

an x-ray source having a spot size width 'y'; and a multiple-total-external reflection monolithic capillary optic ("optic") having an input and an output, and being positioned such that said input to said optic faces said x-ray source and is disposed at an optic-to-source distance of less than 60 millimeters, said optic having multiple channels each of which has an input aimed at the x-ray source and an output aimed at an output focal point spaced from the output of said optic, said output of said optic providing said focused x-ray beam.

8. The apparatus of claim 7, wherein said spot size width 'y' is of 100 micrometers, the optic-to-source distance is approximately 27 millimeters, and said optic has an output focal length of approximately 2 millimeters.

9. The apparatus of claim 8, wherein said optic input has a diameter of 7 millimeters and the input of each channel of said multiple channels in said optic is 14 micrometers.

10. The apparatus of claim 7, wherein said spot size width 'y' of <300 micrometers.

11. The apparatus of claim 7, wherein said spot size width 'y' is sufficiently small to maximize intensity of said focused x-ray beam with spot width 'w' with said optic disposed at said optic-to-source distance of <60 millimeters.

* * * * *

UNITED STATES PATENT AND TRADEMARK OFFICE

CERTIFICATE OF CORRECTION

PATENT NO. : 5,570,408

DATED : Oct. 29, 1996

INVENTOR(S) : David M. Gibson

It is certified that error appears in the above-indentified patent and that said Letters Patent is hereby corrected as shown below:

Column 1, line 7, between "70NANB2H1250" and "the" insert --awarded by the Department of Commerce. Accordingly,--.

Signed and Sealed this

Twenty-third Day of September, 1997

*Attest:*

Bruce Lehman

BRUCE LEHMAN

*Attesting Officer*

*Commissioner of Patents and Trademarks*

US005570408C1

(12) EX PARTE REEXAMINATION CERTIFICATE (5175th)

United States Patent
Gibson

(10) Number: US 5,570,408 C1
(45) Certificate Issued: Aug. 9, 2005

(54) HIGH INTENSITY, SMALL DIAMETER X-RAY BEAM, CAPILLARY OPTIC SYSTEM

(75) Inventor: David M. Gibson, Voorheesville, NY (US)

(73) Assignee: X-Ray Optical Systems, Inc., Albany, NY (US)

Reexamination Request:
No. 90/006,135, Oct. 30, 2001

Reexamination Certificate for:

| | |
|---|---|
| Patent No.: | **5,570,408** |
| Issued: | **Oct. 29, 1996** |
| Appl. No.: | **08/395,714** |
| Filed: | **Feb. 28, 1995** |

Certificate of Correction issued Sep. 23, 1997.

(51) Int. Cl.[7] ..... G21K 1/02
(52) U.S. Cl. ..... 378/145; 378/84
(58) Field of Search ..... 378/34, 84, 85, 378/145, 147, 148, 149

(56) References Cited

U.S. PATENT DOCUMENTS

| | | | | |
|---|---|---|---|---|
| 3,821,510 | A | 6/1974 | Muncheryan | 219/121 L |
| 3,979,621 | A | 9/1976 | Yates | 313/105 |
| 3,979,637 | A | 9/1976 | Siegmund | 315/12 R |
| 4,266,548 | A | 5/1981 | Davi | 128/303.1 |
| 4,287,425 | A | 9/1981 | Elliott, Jr. | 250/445 |
| 4,418,689 | A | 12/1983 | Kanazawa | 128/6 |
| 4,583,539 | A | 4/1986 | Karlin et al. | 128/303.1 |
| 4,669,467 | A | 6/1987 | Willett et al. | 128/303.1 |
| 4,780,903 | A | 10/1988 | Soezima | 378/145 |
| 4,788,975 | A | 12/1988 | Shturman et al. | 128/303.1 |
| 4,887,282 | A | 12/1989 | Meuller | 378/34 |
| 4,950,939 | A | 8/1990 | Tosswill | 313/103 |
| 4,987,582 | A | 1/1991 | Webster et al. | 378/85 |
| 5,001,737 | A | 3/1991 | Lewis et al. | 378/147 |
| 5,016,267 | A | 5/1991 | Wilkins | 378/84 |
| 5,175,755 | A | 12/1992 | Kumakhov | 378/34 |
| 5,192,869 | A | 3/1993 | Kumakhov | 250/505.1 |
| 5,276,724 | A | 1/1994 | Kumasaka et al. | 378/34 |
| 5,497,008 | A | 3/1996 | Kumakhov | 250/505 |
| 5,744,813 | A | 4/1998 | Kumakhov | 250/505.1 |

FOREIGN PATENT DOCUMENTS

| | | | |
|---|---|---|---|
| DE | DT 18 03 806 B | 6/1970 | G21K/1/06 |
| DE | 240 091 A1 | 10/1986 | |
| DE | 44 11 330 | 9/1995 | C03B/37/15 |
| GB | 1 227 929 | 4/1971 | G21G/3/06 |
| GB | 1 474 955 | 5/1977 | G21K/1/02 |
| JP | 42-21460 | 10/1967 | |
| JP | 56-067806 | 6/1981 | G02B/5/17 |
| JP | 59-072052 | 4/1984 | |
| JP | 5-27840 | 1/1985 | |
| JP | 60-033227 | 2/1985 | C03B/37/028 |
| JP | 62-106352 | 5/1987 | |
| JP | 7-40080 | 12/1987 | |
| JP | 01-185497 | 7/1989 | |
| JP | 7-11600 | 1/1990 | |
| JP | 02-216100 | 8/1990 | |
| SU | 1322888 A1 | 7/1984 | G21K/1/06 |
| SU | 1551666 A1 | 4/1988 | |
| SU | 1597009 A1 | 9/1988 | |
| SU | 1769623 A1 | 12/1989 | |
| SU | 1776149 A1 | 2/1990 | |
| SU | 1702811 A1 | 4/1990 | |
| WO | WO 88/01428 | 2/1988 | G21K/1/06 |

OTHER PUBLICATIONS

Kumakhov, M.A., "Radiation of Channeled Particles in Crystals", Moskow, Energoatomizdat, p. 35, second paragraph from the bottom, (1986).

(Continued)

*Primary Examiner*—David V Bruce

(57) ABSTRACT

A system comprising a novel combination of a multiple-channel monolithic capillary optic and an x-ray source with a spot size of less than 300 microns to produce a high intensity small diameter x-ray beam is described. A system of this invention can be easily adapted for use in the analysis of small samples where an intense quasi-parallel, or converging x-ray beam is required.

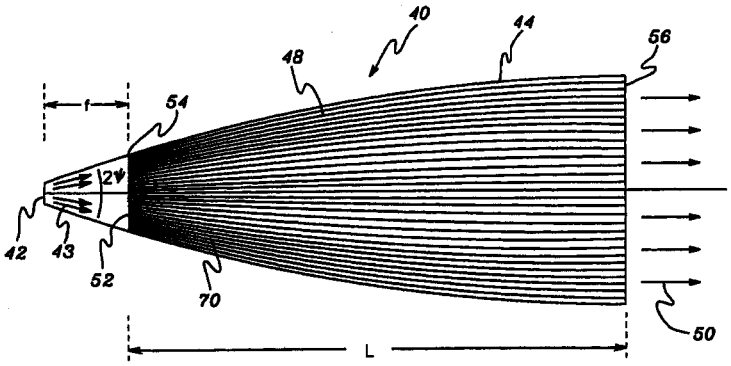

OTHER PUBLICATIONS

Kovantsev, V.E. et al., "X–Ray Probe Version of Local X–Ray Spectral Method of Analysis", the I.V. Kurchatov Institute of Atomic Energy, pp. 1–5 (1991).

Dr. Woldseth, "X–Ray Energy Spectrometry", Kevex Corporation, pp. 41–42, 70, 81, FIG. 2.28, p. 83 and p. 130 (1973).

*Encyclopedia of Modern Machinery. Automatization of production and industrial electronics*, vol. 3, Moscow, Soviet Encyclopedia, pp. 275–275 (1964)–partial translation of pages 274–275 provided with portion of Russian enclycopedia.

Kumakhov; Irradiation of Charged Particles In Crystals (Energoatomizdat, Moscos 1986) p36—RUSSIAN.

Arkadjev; Poverkhn. Fiz. Khim. Mekh. No. 2 pp 44–77 (1987)—RUSSIAN.

Arkadjev; Pis'ma Zh; Tekh vol. 14 pp. 97–98 (1988)—RUSSIAN.

Excerpt from the Book of Abstracts from the "III–rd All–Union Conference on Radiation of Relativistic Particles in Crystals," May 25–30, 1988, in Naltchik, pp. 174–223.

Electronics, Encyclopedic Dictionary, "Soviet Encyclopedy", Moscow, 1990, pp. 254–257.

Yan Yiming, Ding Xunliang, Wang Dachun , "A New X–Ray Lens And Its Applications", *Advances in X–Ray Analysis*, vol. 37, pp. 507–514, (1994).

Guan–Jye Chen, R.K. Cole, F. Cerrina, "Image Formation in Capillary Arrays—The Kumakhov Lens", *SPIE*, vol. 1924, pp. 353–361, (1993).

Walter M. Gibson, Muridan A. Kumakhov, "Applications of X–ray and Neutron Capillary Optics", *SPIE*, vol. 1736, *X–Ray Dector Physics and Applications*, pp. 172–189, (1992).

M.A. Kumakhov, F.F. Komarov, "Multiple Reflection From Surface X–Ray Optics", *Physics Reports*. (*Review Section of Physics Letters*), 191, No. 5, pp. 289–350, (1990).

"The IV–th All–Union Conference on Interaction of Radiation with Solids", *Book of Abstracts*, pp. 1–187 (May 15–19, 1990). Elbrus settlement, Kabardino–Balkarian ASSR, USSR.

M.A. Kumakhov, "Channeling of Photons and New X–Ray Optics", *Nuclear Instruments and Methods In Physics Research B, B48*, pp. 283–286, (Mar. 1990).

V.A. Arkad'ev, A.I. Kolomiĭtsev, M.A. Kumakhov, I. Yu. Ponomarev, I.A. Khodeev, Yu. P. Chertov, and I.M. Shakhparonov, "Wide–band X–ray Optics With a Large Angular Aperture", *Sov. Phys. Usp*. 32(3), pp. 271–276 (Mar. 1989).

V.A. Arkadiev, R.F. Fayazov, M.A. Kumakhov, "Design of a Wide–Band System for Focusing A Hard X–Rays", I.V. Kurchatov Institute of Atomic Energy, IAE–4711/3, pp. 1–40, (Moscow—1988).

N.S. Kapany, "Fiber Optics Principles and Application", *Academic Press Inc.*, pp. 137–138, (1967).

J. B. Ullrich et al., "Development of Monolithic Capillary Optics for x–ray Diffraction Applications", SPIE, vol. 2278 X–Ray and UV Detectors (1994).

M. Kumakhov, "A History of the Evolution of the X–Ray and Neutron Capillary Optics", Optics of Beams, Institute for Roenten Optical Systems, Moscow, Russia, 1993.

M. Kumakhov, "State and Perspectives of Capillary Roentgen Optics", Proceedings of SPIE vol. 2011. Multilayer and Grazing Incidence X–Ray/EUV Optics II. Jul. 14–16, 1994. San Diego, California.

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–11 is confirmed.

New claims 12 and 13 are added and determined to be patentable.

*12. The apparatus of claim 1, wherein the x-ray source comprises a surface from which x-rays are emitted as a result of collisions between electrons accelerated toward the surface and atoms on the surface.*

*13. The apparatus of claim 7, wherein the x-ray source comprises a surface from which x-rays are emitted as a result of collisions between electrons accelerated toward the surface and atoms on the surface.*

* * * * *